US009279634B2

(12) United States Patent
Shipman et al.

(10) Patent No.: US 9,279,634 B2
(45) Date of Patent: Mar. 8, 2016

(54) FIREARM BOLT CLEANING TOOL

(75) Inventors: Kel Shipman, Rochester, NY (US); Nicholas Williams, Turin, NY (US)

(73) Assignee: The Otis Patent Trust, Lyons Falls, NY (US)

( * ) Notice: Subject to any disclaimer, the term of this patent is extended or adjusted under 35 U.S.C. 154(b) by 0 days.

(21) Appl. No.: 13/350,439

(22) Filed: Jan. 13, 2012

(65) Prior Publication Data

US 2012/0186127 A1 Jul. 26, 2012

Related U.S. Application Data

(60) Provisional application No. 61/433,245, filed on Jan. 16, 2011, provisional application No. 61/488,539, filed on May 20, 2011.

(51) Int. Cl.
*F41A 29/02* (2006.01)
*F41A 29/00* (2006.01)

(52) U.S. Cl.
CPC ..... *F41A 29/02* (2013.01)

(58) Field of Classification Search
CPC ..... F41A 29/00; F41A 29/02; F41A 29/04; F41A 35/00
USPC ..... 42/95, 108
See application file for complete search history.

(56) References Cited

U.S. PATENT DOCUMENTS

| | | | | |
|---|---|---|---|---|
| 95,468 | A * | 10/1869 | Felton | 15/104.2 |
| 190,123 | A | 5/1877 | Budd | |
| 358,304 | A | 2/1887 | Simpson | |
| 684,983 | A * | 10/1901 | Greenfield | 15/104.19 |
| 1,522,837 | A * | 1/1925 | Rebar | 15/104.16 |
| 2,420,044 | A | 5/1947 | Jowett | |
| 2,559,376 | A | 7/1951 | Schnitger | |
| 4,399,627 | A | 8/1983 | Malesky et al. | |
| 4,901,465 | A * | 2/1990 | Hsu | 42/95 |
| 5,815,873 | A * | 10/1998 | Jones | 15/106 |
| 7,644,529 | B2 | 1/2010 | Hopper et al. | |
| 8,250,800 | B1 * | 8/2012 | Johnson | 42/95 |
| 2006/0236584 | A1 * | 10/2006 | Williams | 42/95 |
| 2007/0261288 | A1 * | 11/2007 | Perry et al. | 42/95 |
| 2009/0151214 | A1 * | 6/2009 | Williams | 42/95 |
| 2009/0178324 | A1 * | 7/2009 | Hopper et al. | 42/90 |

(Continued)

OTHER PUBLICATIONS http://www.gngtools.com/gngboltcleanerandpolisher-1.aspx dated Apr. 19, 2012 (2 pgs).

(Continued)

*Primary Examiner* — Bret Hayes
*Assistant Examiner* — Derrick Morgan
(74) *Attorney, Agent, or Firm* — Harris Beach PLLC

(57) ABSTRACT

A firearm bolt cleaning tool includes a tool core defining a plurality of scraper surfaces. The scraper surfaces include a first gas ring scraper surface, a first bolt face scraper surface extending from a terminus of the first gas ring scraper surface, and a first bolt cylinder scraper surface extending from a terminus of the first bolt face scraper surface. Opposing positioned are a second gas ring scraper surface, a second bolt face scraper surface extending from a terminus of the second gas ring scraper surface, and a second bolt cylinder scraper surface extending from a terminus of the second bolt face scraper surface. The first gas ring scraper surface and the second gas ring scraper surface are spaced apart from each other at a distance that is less than a diameter of a cylindrical gas sealing ring holding section of the firearm bolt.

12 Claims, 10 Drawing Sheets

(56) References Cited

U.S. PATENT DOCUMENTS

| | | | | |
|---|---|---|---|---|
| 2009/0199345 | A1* | 8/2009 | Morgan | 7/118 |
| 2010/0186769 | A1* | 7/2010 | Jaquish et al. | 134/6 |
| 2011/0168207 | A1* | 7/2011 | Smith | 134/8 |
| 2011/0209380 | A1* | 9/2011 | Iosso et al. | 42/95 |
| 2012/0186128 | A1* | 7/2012 | Williams et al. | 42/95 |

OTHER PUBLICATIONS http://www.brownells.com/.aspx/pid=31833/Product/AR-15-M16-BOLT-RADIUS-SCRAPER dated Apr. 19, 2012 (1 pg).

http://www.m-guns.com/tool_new.php?product=moacks dated Apr. 19, 2012 (2 pgs).

http://www.botachtactical.com/kzcrtcareto.html dated Apr. 19, 2012 (2 pgs).

http://slickguns.com/product/kz-m4crst-carbon-removal-super-tool-1438-after-coupon-free-shipping dated Apr. 19, 2012 (2 pgs).

ISA/US International Search Report and Written Opinion for corresponding International Application No. PCT/US2012/021328 dated May 11, 2012 (10 pgs).

* cited by examiner

FIREARM BOLT CLEANING TOOL

CROSS REFERENCE TO RELATED APPLICATION

Reference is made to and this application claims priority from and the benefit of U.S. Provisional Application Ser. No. 61/488,539, filed May 20, 2011, entitled "BOLT AND BOLT CARRIER CLEANING SYSTEM AND TOOLS WITH INTEGRATED PULL-THROUGH HANDLE", and U.S. Provisional Application Ser. No. 61/433,245, filed Jan. 16, 2011, entitled "BOLT AND BOLT CARRIER CLEANING SYSTEM AND TOOLS", which applications are incorporated herein in their entirety by reference.

FIELD OF THE INVENTION

The present disclosure relates generally to a system and tools for cleaning firearm components including a bolt and bolt carrier, for firearms such as an M4, an M16, and other rifles and carbines, for example.

BACKGROUND OF THE INVENTION

Carbon and other residue from gunpowder and from firearm discharge reactions accumulate on firearm components over time, with deleterious effects on cleanliness, performance, and longevity of the firearm. Firearm discharge residue accumulates on various firearm components that require disassembly to access and clean. Even then, carbon and other discharge residue tends to be tenuous and difficult to remove. Some firearm components typically need to be scraped with a hard scraping tool to have discharge residue effectively removed, but this must be done without scratching or damaging the firearm components themselves. Various firearm components also have complex shapes that make cleaning discharge residue effectively a challenge. For example, the bolt and bolt carrier of a 5.56 or 7.62 cartridge rifle have complicated shapes, such as the concave shape of the nose of the bolt, that have proven to be persistently difficult to clean effectively. A number of specialized scraping tools have been introduced to clean firearm components, but have had substantial shortcomings.

The discussion above is merely provided for general background information and is not intended to be used as an aid in determining the scope of the claimed subject matter.

SUMMARY OF THE INVENTION

Various tools for cleaning bolts and bolt carriers are disclosed herein. In an illustrative embodiment, a firearm bolt cleaning tool includes a tool core defining a plurality of scraper surfaces. The scraper surfaces include a first gas ring scraper surface, a first bolt face scraper surface extending from a terminus of the first gas ring scraper surface, and a first bolt cylinder scraper surface extending from a terminus of the first bolt face scraper surface. The bolt cleaning tool further includes a second gas ring scraper surface positioned opposing the first gas ring scraper surface, and a second bolt face scraper surface extending from a terminus of the second gas ring scraper surface. The second bolt face scraper surface is positioned opposing the first bolt face scraper surface. The bolt cleaning tool further includes a second bolt cylinder scraper surface extending from a terminus of the second bolt face scraper surface. The second bolt cylinder scraper surface is positioned opposing the first bolt cylinder scraper surface. The first gas ring scraper surface and the second gas ring scraper surface are spaced apart from each other at a distance that is less than a diameter of a cylindrical gas sealing ring holding section of the firearm bolt.

In another illustrative embodiment, the first and second gas ring scraper surfaces, the first and second bolt face scraper surfaces, and the first and second bolt cylinder scraper surfaces are shaped to conformingly engage a portion of the firearm bolt in an off-center engagement with the portion of the firearm bolt.

In another illustrative embodiment, the first and second gas ring scraper surfaces, the first and second gas ring scraper surfaces, and the first and second bolt cylinder scraper surfaces are positioned at a first end of the tool core, and a carrier chamber brush is positioned at a second end of the tool core opposite the first end of the tool core. The carrier chamber brush includes a brush head attached to the second end of the tool core, and a plurality of groups of axially extending bristles secured to the brush head.

In another illustrative embodiment, the carrier chamber brush includes an odd number of evenly spaced groups of axially extending bristles.

BRIEF DESCRIPTION OF THE DRAWINGS

The features described herein can be better understood with reference to the drawings described below. The drawings are not necessarily to scale, emphasis instead generally being placed upon illustrating the principles of the invention. In the drawings, like numerals are used to indicate like parts throughout the various views.

DETAILED DESCRIPTION OF THE INVENTION

Figure 1:
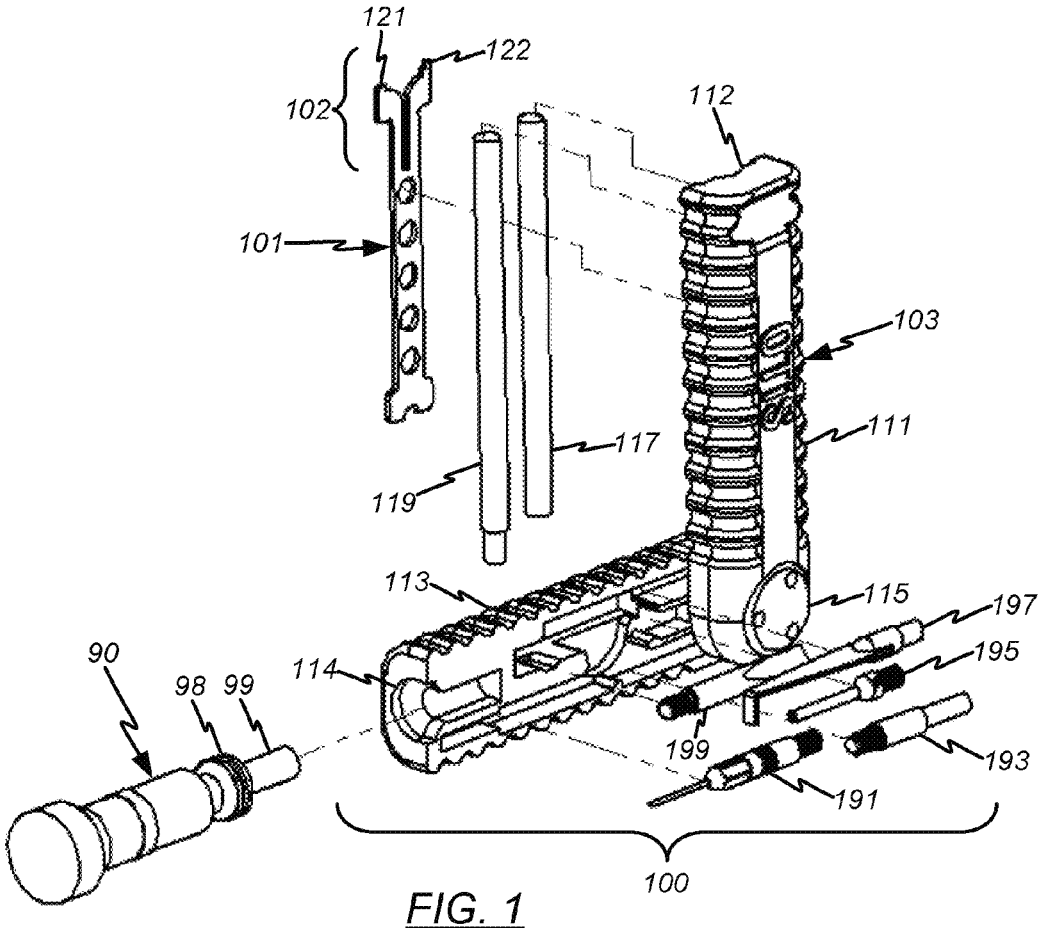
FIG. 1 depicts an exploded, perspective view of an illustrative embodiment of a bolt tool in an open position, with a bolt.
Figure 3:
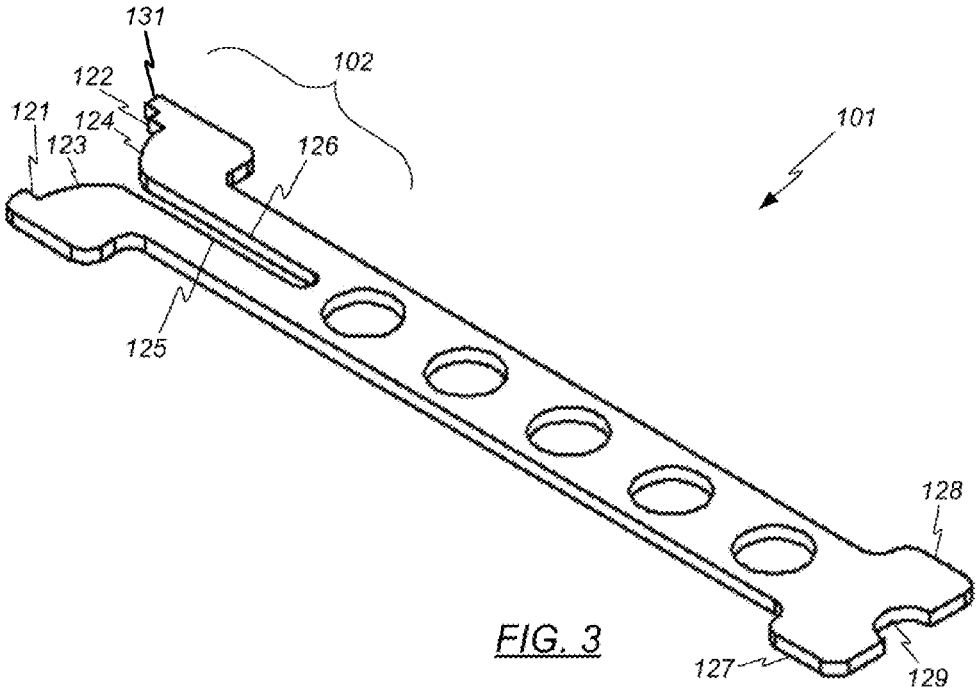
FIG. 3 depicts a perspective view of an illustrative embodiment of a bolt tool core for a bolt tool.

FIG. 1 depicts an exploded, perspective view of an illustrative embodiment of a bolt tool 100 in an open position, together with a bolt 90, which may for example be a bolt from an M4 or other M16 rifle. The bolt tool 100 includes a tool core 101 and a handle 103 to which the tool core 101 is configured to be securely fastened. Tool core 101 is formed with various surfaces that serve different purposes, including surfaces on a forward section 102 of tool core 101 that are specially suited for scraping a bolt 90, in particular for scraping a bolt face 99 and adjoining gas ring surface 98 of bolt 90. It is noted that in the illustrated embodiment, the bolt face 99 includes a cylindrical surface and a concave surface extending radially outward from the terminus of the cylindrical portion. In other embodiments, the bolt face may include other geometries. Tool core 101 is more closely depicted in a different perspective view in FIG. 3 and is further explained below.

Figure 2:
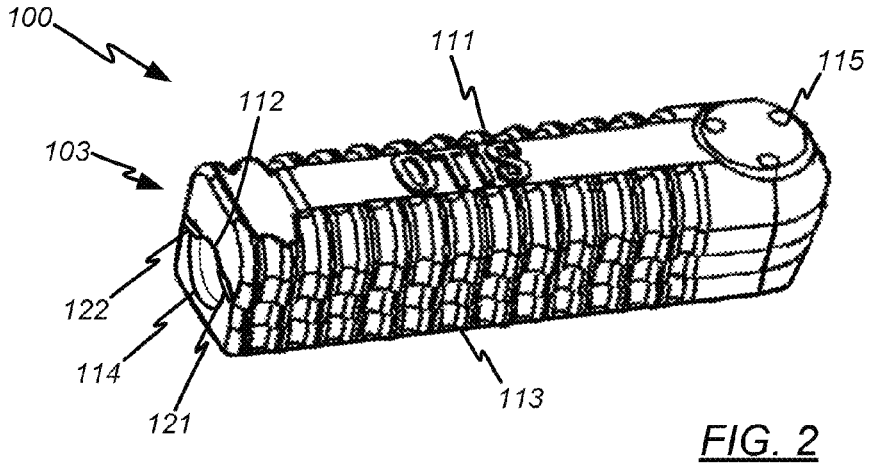
FIG. 2 depicts a perspective view of an illustrative embodiment of a bolt tool in a closed position.

The handle 103 includes a first side 111, a second side 113, and a hinge 115 that rotationally connects the first side 111 and the second side 113. Handle 103 is shown in FIG. 1 with tool core 101 removed and in an open position, in which first side 111 is rotated relative to second side 113, which allows access inside handle 103 and allows tool core 101 to be removed from being securely fastened within handle 103. FIG. 2 depicts a perspective view of bolt tool 100, of the same illustrative embodiment of FIG. 1, in a closed position, in which first side 111 and second side 113 of handle 103 are securely engaged together.

When handle 103 is in its open position, as depicted in FIG. 1, it also allows access to compartments inside handle 103 that may be configured to securely hold a number of other separable components besides tool core 101. These separable components may include a female rod 117, a male rod 119, a scraper 199, a brush 193, a pin punch 195, a locking lug 191, and a locking lug scraper 197. Each of these components may have its own fitted compartment inside handle 103. In other embodiments, none or only some of these separable components may be included, or other components may also be included, and a handle may be formed with fitted compartments inside for whatever combination of components, if any, are included. These compartments may be accessible when the handle is in the open position, and inaccessible when the handle is in the closed position.

Handle 103 holds tool core 101 in an off-center position. The first side 111 of handle 103 has a minor aperture portion 112, and the second side 113 of handle 103 has a major aperture portion 114, that together form an aperture in handle 103 when handle 103 is in the closed position, as shown in FIG. 2, and that hold the tool core 101 in the off-center position defined by the junction of minor aperture portion 112 and major aperture portion 114 of handle 103. The forward section 102 of tool core 101 includes first gas ring scraper surface 121 and second gas ring scraper surface 122 on opposing ends thereof, as seen in FIG. 1, which are seen in an off-center position in the aperture formed by minor aperture portion 112 and major aperture portion 114 of handle 103, as seen in FIG. 2. The aperture formed by minor aperture portion 112 and major aperture portion 114 of handle 103 is sized and formed to receive the bolt face 99 and adjoining gas ring surface 98 of bolt 90, and thereby engaging the inner surfaces of the forward section 102 of tool core 101 together with the bolt face 99 and adjoining gas ring surface 98 of bolt 90, in an off-center alignment with these portions of bolt 90.

Figure 4:
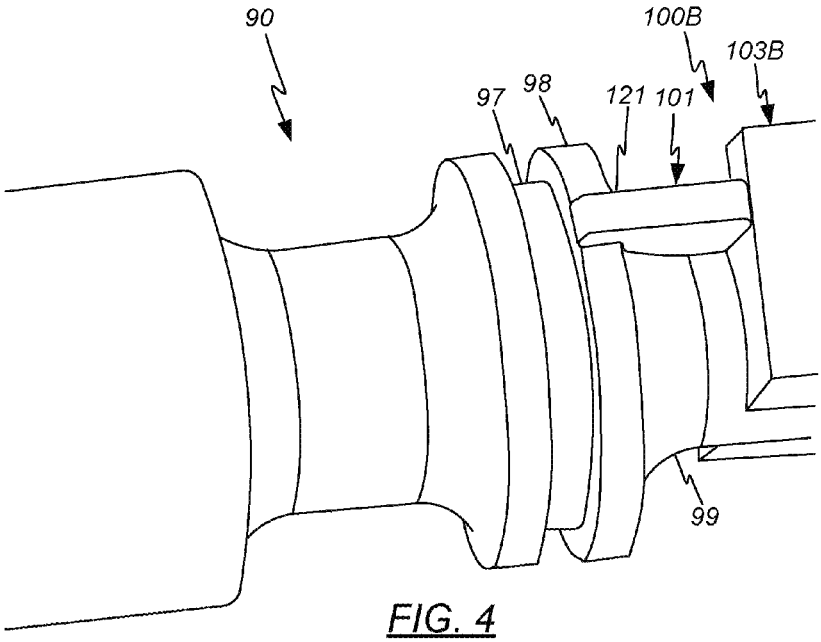
FIG. 4 depicts a perspective view of one end of a bolt tool engaged with a bolt, according to an illustrative embodiment.
Figure 6:
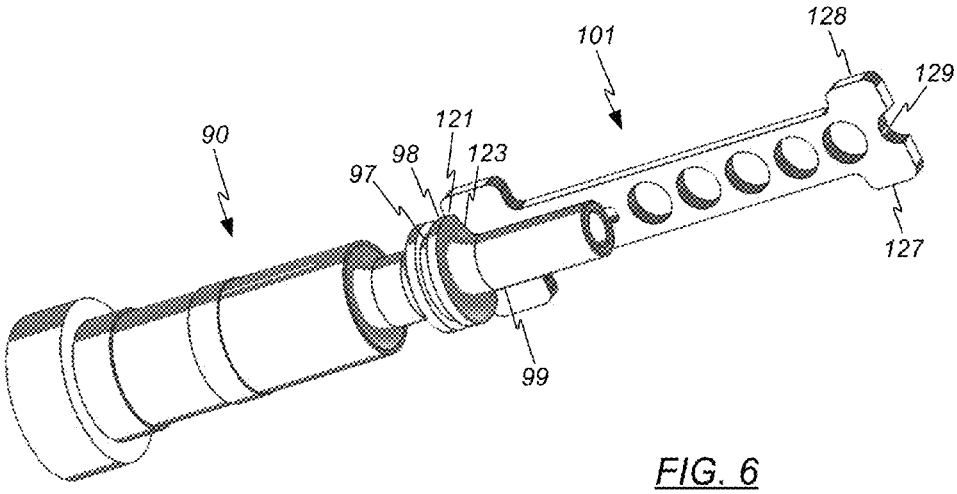
FIG. 6 depicts a perspective view of a bolt tool core engaged with a bolt, according to an illustrative embodiment.
Figure 7:
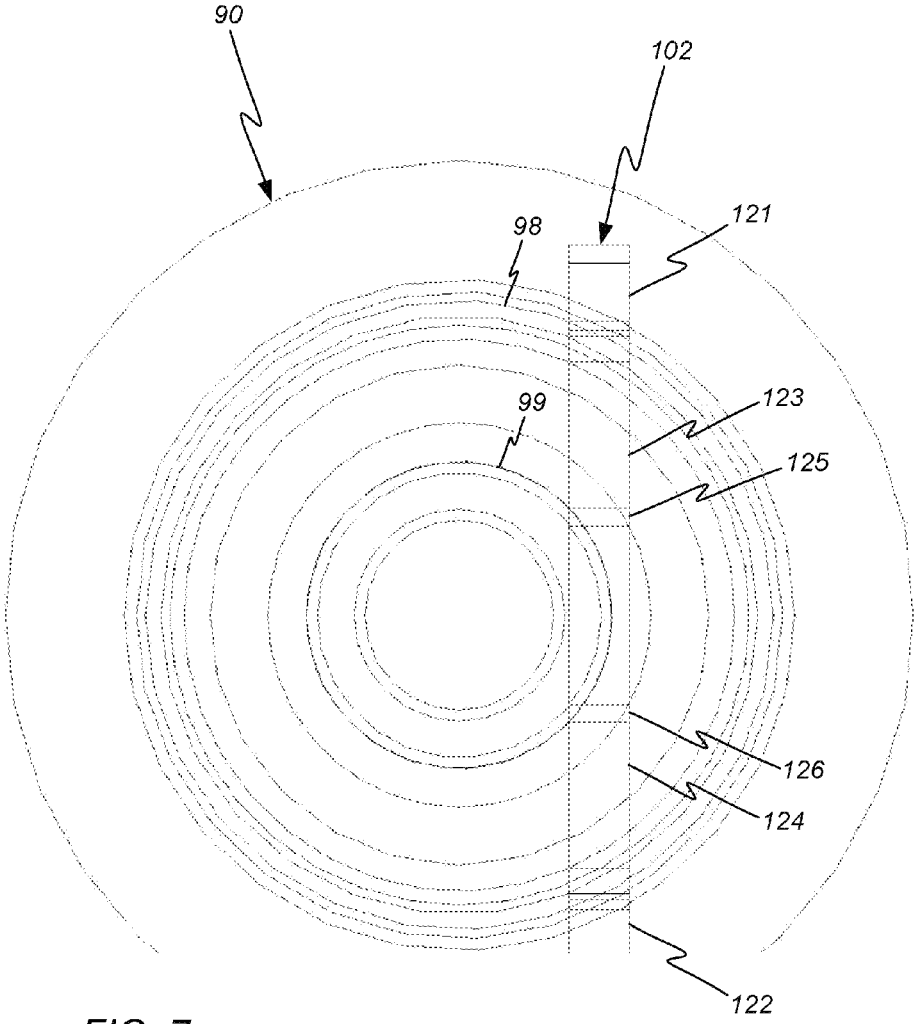
FIG. 7 depicts an on-axis plan view of one end of a bolt tool core engaged with a bolt, according to an illustrative embodiment.

This off-center engagement of tool core 101 with the bolt face 99 and adjoining gas ring surface 98 of bolt 90, is further depicted in FIGS. 4, 6, and 7 without being obscured by handle 103. For example, bolt 90 may be an M16 rifle bolt, and tool core 101 may be sized to conformingly engage bolt face 99 and adjoining gas ring surface 98 of bolt 90 in an off-center engagement with both the bolt face 99 and adjoining gas ring surface 98. In other embodiments, a tool core may be sized to conformingly engage the contours of a bolt for a different type of firearm such as one that uses 5.56 cartridge, a 7.62 cartridge, or other type of round.

As noted above, FIG. 3 depicts a perspective view of tool core 101, in accordance with the same illustrative embodiment of FIGS. 1 and 2. Various aspects of the geometry of tool core 101 are explained as follows. The forward section 102 of tool core 101 includes various inner surfaces that conform to the shape and size of the bolt face 99 and adjoining gas ring surface 98 of bolt 90 in an off-center alignment. These various inner surfaces include first gas ring scraper surface 121 and second gas ring scraper surface 122, as noted above, but which can be more clearly identified in the larger view afforded in FIG. 3. These inner surfaces also include first bolt face scraper surface 123, [which may be convex] second bolt face scraper surface 124, first bolt cylinder scraper surface 125, and second bolt cylinder scraper surface 126. The second bolt face scraper surface 124 is positioned opposing the first bolt face scraper surface 123. The first gas ring scraper surface 121 extends from a first end of the first bolt face scraper surface 123, and the second gas ring scraper surface 122 extends from a first end of the second bolt face scraper surface 124, such that the second gas ring scraper surface 122 is positioned opposing the first gas ring scraper surface 121. The first bolt cylinder scraper surface 125 extends from a second end of the first bolt face scraper surface 123, and the second bolt cylinder scraper surface 126 extends from a second end of the second bolt face scraper surface 124, such that the second bolt cylinder scraper surface 126 is positioned opposing the first bolt cylinder scraper surface 125.

The second gas ring scraper surface 122 is positioned parallel to the first gas ring scraper surface 121, and the second bolt cylinder scraper surface 126 is positioned parallel to the first bolt cylinder scraper surface 125. The first bolt cylinder scraper surface 125 and the second bolt cylinder scraper surface 126 of the tool core 101 are sized to conformingly engage an off-center section of the cylindrical part of the bolt face 99 of the bolt 90, and are significantly longer than the first gas ring scraper surface 121 and the second gas ring scraper surface 122 of the tool core 101, which are sized to conformingly engage an off-center section of the shorter and wider gas ring surface 98 of the bolt 90. The first bolt cylinder scraper surface 125 and the second bolt cylinder scraper surface 126 are spaced apart from each other at a distance that is less than the diameter of the cylindrical bolt face 99 of the bolt 90, as seen for example in FIGS. 6 and 7, which configures these surfaces of tool core 101 for their off-center conforming contact with bolt face 99.

The first and second gas ring scraper surfaces 121, 122, the first and second bolt face scraper surfaces 123, 124, and the first and second bolt cylinder scraper surfaces 125, 126 are thereby shaped to conformingly engage a portion of bolt 90 in an off-center engagement with the portion of bolt 90. In particular, for example, the first gas ring scraper surface 121 and the second gas ring scraper surface 122 are spaced apart from each other at a distance that is less than the diameter of the gas ring surface 98 of bolt 90. Gas ring surface 98 serves as a gas sealing ring holding section of bolt 90; gas sealing rings (not depicted here) are typically disposed in annular depression 97 in gas ring surface 98, seen in FIG. 4.

Forward section 102 of tool core 101 also has a nib 131 extending from an end of the forward section adjacent the second gas ring scraper surface 122, which doesn't conform to the shape of bolt face 99 or adjoining gas ring surface 98 of bolt 90, but provides its own separate, additional uses. The nib 131 may be sized to be able to fit in the loop of a cotter pin, and may be used to hook into the loop of the firing pin retaining pin in a bolt carrier to remove the firing pin retaining pin. The nib 131 may also be used as a pin punch for removing the extractor pin, for example.

Tool core 101 may illustratively be composed of stainless steel, and may be formed using waterjet cutting, for example. In other embodiments, tool core 101 may be composed of any of a variety of other materials, such as aluminum, titanium, various alloys, for example, and may be formed using any of a number of techniques such as laser cutting, computer numerical control (CNC) machining, or other methods, for example. Tool core 101 features mostly rectangular edges, or right-angle edges with curved convex or concave surfaces, which facilitates fabrication relative to more complicated forms.

Tool core 101 provides a number of additional advantages. Tool core 101 is thin enough to allow a degree of flexibility to aid in truly conforming to the surfaces of the gas ring surface 98 and bolt face 99 of bolt 90, instead of being thick enough to be completely rigid and unable to flex to conform to the complex surfaces of bolt 90. This flexible conformity facilitates the edges of the forward section 102 of tool core 101 forming a true scraping edge against the surfaces of bolt 90. The sizing and shaping of tool core 101 that result in the off-center engagement with bolt 90 also ensure that it is the edges of the surfaces of the forward section 102, not the full-on surfaces, that engage the surfaces of bolt 90, which also facilitates a true scraping engagement. The off-center conforming shape also means tool core 101 has a smaller size than if it were sized to conform over the center of the bolt face 99 of the bolt 90. This smaller size, along with the thinness of tool core 101, also makes for a lighter weight, which in turn makes tool core 101 more suitable for field use. This smaller size also enables tool core 101 to fit inside the stock of a rifle to which bolt 90 belongs, such as an M16, while larger bolt scraper tools would not be able to.

As noted above, FIG. 4 depicts a perspective view of one end of a bolt tool 100B engaged with a bolt 90, according to a somewhat different illustrative embodiment that has a smaller handle 103B that still houses an identical tool core 101, and which better reveals how a handle may provide a guiding engagement with a bolt face 99 of a bolt 90 while securely gripping a tool core 101 in an off-center conforming contact with bolt face 99 and gas ring surface 98 of bolt 90.

Figure 5:
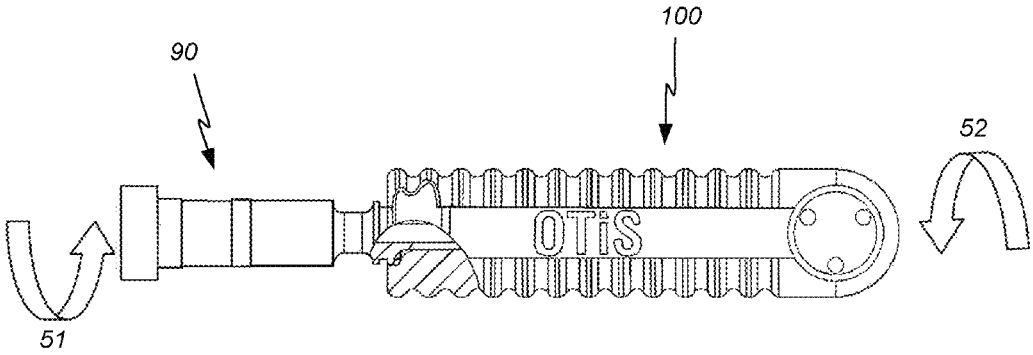
FIG. 5 depicts a side plan view of a bolt tool engaged with a bolt, according to an illustrative embodiment.

FIG. 5 depicts a side plan view of the bolt tool 100 engaged with a bolt 90, and depicts rotational motion 51 applied to bolt 90 and simultaneous rotational motion 52 applied to bolt tool 100, demonstrating the motions a user may perform to use bolt tool 100 to scrape the engaged surfaces of bolt 90.

FIG. 6 depicts a perspective view of tool core 101 engaged with bolt 90, without showing handle 103. This provides a better view of the engaging contact of tool core 101 with bolt 90 while tool core 101 is being securely held by handle 103, though tool core 101 may also be used by itself for scraping bolt 90.

FIG. 7 depicts an on-axis plan view of one end, in particular the forward portion 102, of a tool core 101 engaged with a bolt 90. In particular, FIG. 7 illustrates first and second gas ring scraper surfaces 121 and 122 contacting gas ring surface 98; first and second bolt face scraper surfaces 123 and 124 contacting the concave portion of bolt face 99; and first and second bolt cylinder scraper surfaces 125 and 126 contacting the cylindrical portion of bolt face 99. In each case, due to the off-center conforming engagement of tool core 101, a right-angle corner edge of the relevant surface of tool core 101 contacts the opposing surface of bolt 90, forming a true scraping edge against the surfaces of bolt 90. In one illustrative embodiment, only one side of the forward portion surfaces of tool core 101, such as the first bolt face scraper surface 123, the first gas ring scraper surface 121, and the first bolt cylinder scraper surface 125 may form scraping edges. In another illustrative embodiment, surfaces 121 through 126 of tool core 101 all form scraping edges against the opposing surfaces of bolt 90.

Tool core 101 is thereby enabled to achieve a true scraping edge that effectively conforms to the complicated surfaces of the bolt face 99 and cylindrical gas sealing ring holding section 98 of a rifle bolt 90, and that allows a user to effectively scrape a bolt 90 free of carbon and other discharge residue in just a few, quick rotations of a bolt tool 100 in engagement with a bolt 90, and with a bolt tool 100 that is rugged yet very small and lightweight and well-suited to field use.

As best appreciated with reference to FIG. 7, the scraping surfaces 121 through 126 align with bolt 90 at compound angles relative to a radial plane taken through the centerline of the bolt. Stated another way, generating the off-center scraping surfaces 121 through 126 is not a simple matter of creating a scraper profile through the centerline of the bolt and offsetting the profile. Rather, in order for the scraping surfaces 121 through 126 to conform to the bolt surfaces at all points, the scraping profile can be advantageously created with computer-aided graphics programs. The resulting scraper profile (e.g., scraping surfaces 121 through 126) is thus suited for a bolt of a particular model firearm, and would not be adaptable to another model firearm.

Returning to FIG. 3, tool core 101 also includes outwardly-facing flat scraping surfaces 127 and 128 and a concave scraping surface 129, grouped at a second end of tool core 101 opposing the first end or forward section 102 of tool core 101. The outwardly-facing flat scraping surfaces 127 and 128 may be used to clean the opposite end of bolt 90, at the far end of bolt 90 from bolt face 99. The concave scraping surface 129 is shaped and sized to conformingly engage and scrape a surface of a rifle firing pin. A wide variety of specialized scraping surfaces for cleaning all areas of bolt 90 are therefore provided in a single tool in the form of tool core 101.

Figure 8:
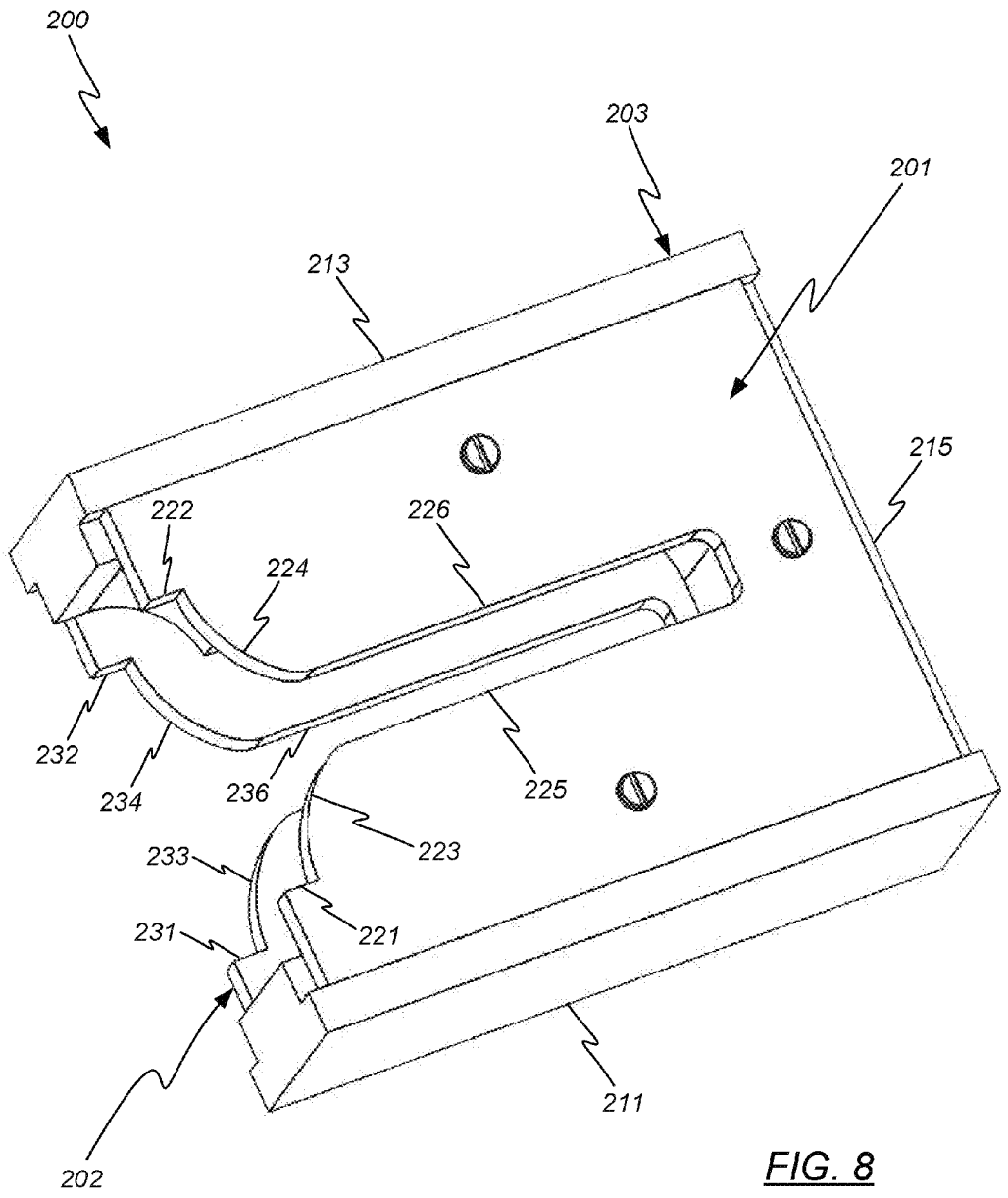
FIG. 8 depicts a perspective view of a bolt tool that includes two scraper walls, according to an illustrative embodiment.
Figure 9:
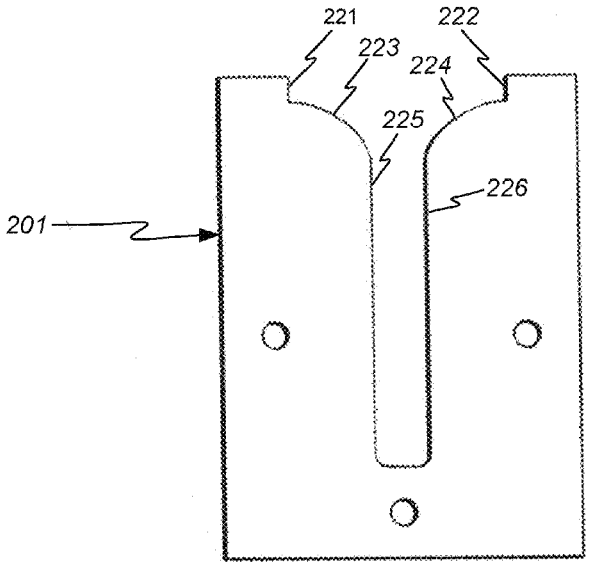
FIG. 9 depicts a top plan view of a scraper wall, according to an illustrative embodiment.
Figure 10:
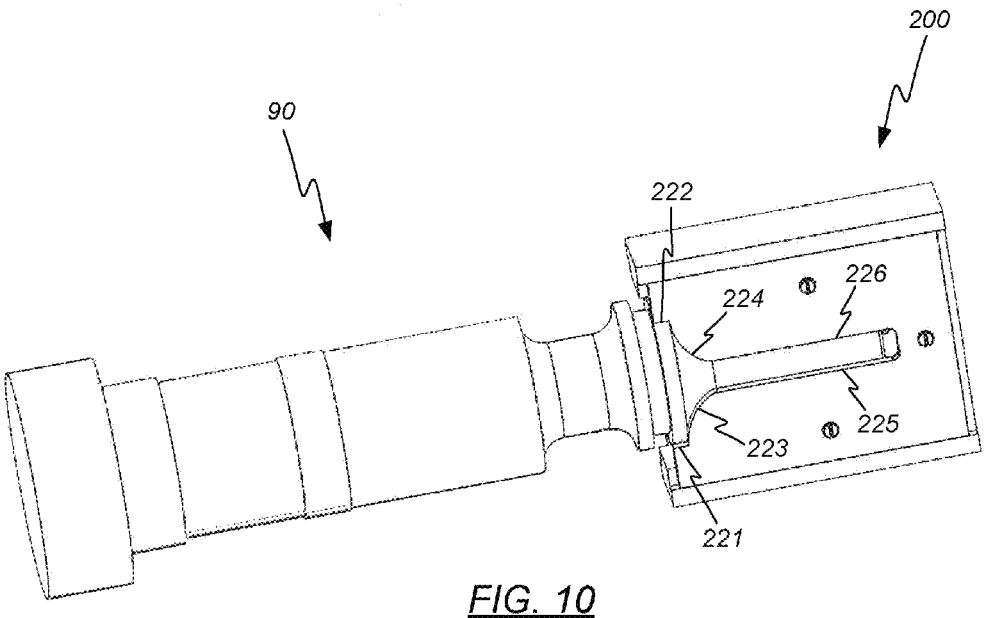
FIG. 10 depicts a perspective view of a bolt tool according to an illustrative embodiment conformingly engaged with a rifle bolt for scraping the bolt clean.

FIG. 8 depicts a perspective view of a bolt tool 200 in another illustrative embodiment that includes two scraper walls 201 and 202, and a brace 203 to which the scraper wall or scraper walls 201 and/or 202 are secured. In another illustrative embodiment, a bolt tool may be similar to bolt tool 200 except only have one scraper wall. FIG. 9 depicts a top plan view of scraper wall 201 by itself. Scraper wall 201 may itself serve as a bolt scraping tool. FIG. 10 depicts bolt tool 200 conformingly engaged with the bolt face 99 and cylindrical gas sealing ring holding section 98 of a rifle bolt 90, such that it may be rotated to scrape these bolt surfaces clean.

Scraper walls 201 and 202 have surfaces and attributes that are analogous in some ways to those of forward section 102 of tool core 101 as described above, such as providing true scraping edges that conform to the contours of the bolt face 99 and cylindrical gas sealing ring holding section 98 of bolt 90, allowing for very rapid and very thorough and effective scraping of these bolt surfaces, so that a user can effectively clean carbon and other debris from these bolt surfaces with a few rotating motions of the bolt tool 200 or an individual scraper wall 201 around the bolt.

In particular, scraper wall 201 has first and second gas ring scraper surfaces 221 and 222 opposing each other for conformingly contacting a gas sealing ring holding section 98, first and second bolt face scraper surfaces 223 and 224 for conformingly contacting the concave portion of a bolt face 99, and first and second bolt cylinder scraper surfaces 225 and 226 for conformingly contacting the cylindrical portion of bolt face 99, all at an off-center position from the central axis of bolt 90, such that right-angle corner edges of each of these surfaces of scraper wall 201 forms a true scraping edge along the contours of the bolt 90. This provides more effective scraping than surfaces sitting face on with the surfaces of the bolt and contacting the surfaces of the bolt across large-scale two-dimensional areas of contact, which prevent a true scraping edge. Scraper wall 202 likewise has first and second opposing gas ring scraper surfaces 231 and 232, first and second opposing bolt face scraper surfaces 233 and 234, and first and second opposing bolt cylinder scraper surfaces 235 and 236 (surface 235 is obscured from view and not labeled in FIG. 8). Brace 203, that holds scraper walls 201 and 202 in place, includes side walls 211 and 213 and a back wall 215 that securely hold scraper walls 201 and 202 in place, at an appropriate distance from each other so that they can both engage the bolt face 99 and gas sealing ring holding section 98 of a bolt 90 in an off-center engaging contact at the same time.

Figure 11:
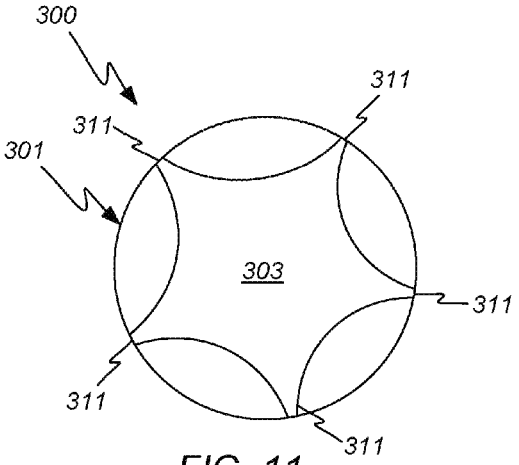
FIG. 11 depicts a top plan view of a carrier interior scraper, according to an illustrative embodiment.
Figure 12:
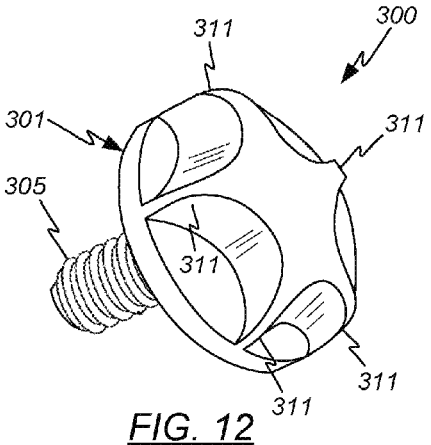
FIG. 12 depicts a perspective view of a carrier interior scraper, according to an illustrative embodiment.

FIG. 11 and FIG. 12 depict another tool, a carrier interior scraper 300, that comprises a number of convex ridges 311 supported between a base 301 and a central spar 303, in an illustrative embodiment, with a top plan view in FIG. 11 and a perspective view in FIG. 12. Base 301 may have a threaded stem 305 for threaded attachment to a rod or cable. The carrier interior scraper 300 may be used for cleaning the interior overshoot area in a bolt carrier of a firearm, such as an M4 or M16, for example. Some of the contours of the interior of a bolt carrier do not have exacting specifications and may vary significantly in shape and tolerances between bolt carriers made by different manufacturers or even the same manufacturer. In an illustrative embodiment, a carrier interior scraper 300 may be composed of brass or some other material that is relatively softer than steel, so that as a carrier interior scraper 300 is used to scrape the interior of a particular bolt carrier, the convex ridges 311 are worn down to conform to the shape of the interior surfaces of that particular bolt carrier.

Carrier interior scraper 300 has five evenly spaced ridges 311 in this illustrative embodiment, and in other embodiments may have three or seven evenly spaced ridges, or may have two or four ridges in an uneven arrangement, for example. Each of these arrangements provides a particular advantage in light of a gas port on the side of the bolt carrier, so that when a carrier interior scraper is used to scrape the interior of a bolt carrier, when one of the ridges crosses the position of the gas port, there is not a diametrically opposite ridge on the opposite side of the carrier interior scraper pushing directly toward the gas port and providing a net off-axis force.

Figure 13:
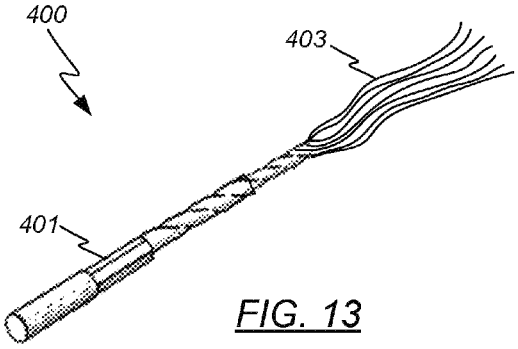
FIG. 13 depicts a perspective view of a long brush, in an illustrative embodiment.
Figure 14:
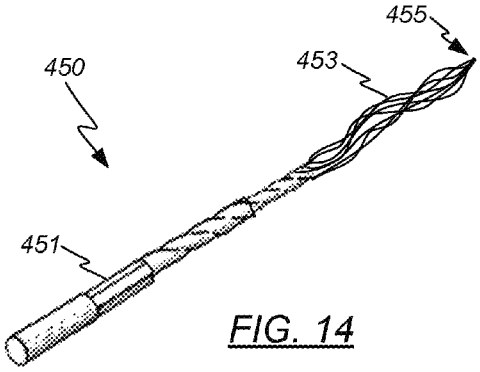
FIG. 14 depicts a perspective view of a long brush, in another illustrative embodiment.

FIG. 13 depicts another tool in the form of a long brush 400 that includes a handle 401 and a number of wire brush bristles 403, in an illustrative embodiment. FIG. 14 depicts a different illustrative embodiment of a long brush 450 that also includes a handle 451 and a number of wire brush bristles 453, but differs in that the ends of the wire brush bristles are fixed together, such as by soldering them together, at a fixed bristle end 455, for example, as opposed to the free bristles of long brush 400. Brushes 400 and 450 may have their handles 401, 451 knurled to provide a good gripping surface. These tools may be used for cleaning the interior of the carrier key on a bolt carrier, as well as other gas ports and gas tube sections on a bolt carrier or other firearm components, for example. The interior of the carrier key and associated gas tube and gas port in fluid communication with the carrier key have complex surfaces that are difficult to get cleaning tools into conforming contact with. Brushes 400 and 450 are advantageous for cleaning these interior surfaces because their bristles 403, 453 are long and are fanned out somewhat from one another.

Brush 450 may provide its own advantages for cleaning these interior surfaces by keeping the ends of the bristles fixed together at fixed bristle end 455, so that all the bristles 453 may be kept together at their front end while the brush 450 is being inserted through the interior surfaces of a carrier key or other components, while the bristles 453 themselves are fanned out behind the fixed bristle end 455 to provide scraping action along the sides of these interior surfaces.

Figure 15:
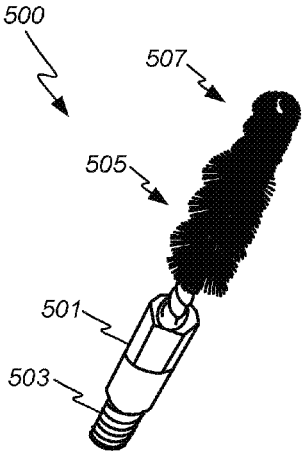
FIG. 15 depicts a perspective view of a chamber brush, in an illustrative embodiment.

FIG. 15 depicts a chamber brush 500 that includes perpendicularly suspended wire brush bristles, in an illustrative embodiment. Chamber brush 500 may be used for cleaning the interior of a bolt carrier of a firearm, for example. This chamber brush has two sections of wire brush bristles, a first section 505 with longer bristles, and a second section 507 with shorter bristles. This chamber brush 500 may be useful for brushing the interior of components such as a bolt carrier, for example. Chamber brush 500 may also have a base 501 with a threaded section 503, for threaded attachment to a rod or flexible cable, such as female rod 117 shown in FIG. 1, for example.

Figure 16:
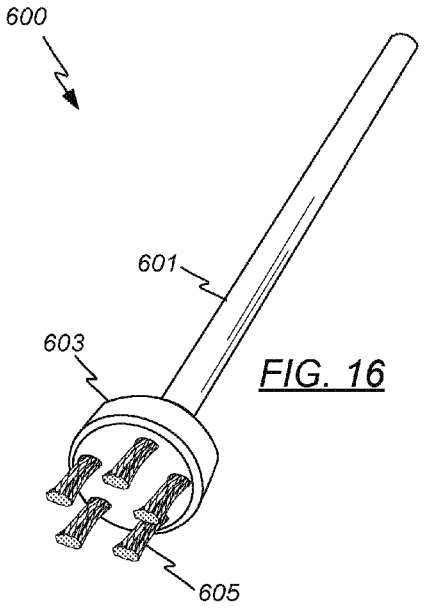
FIG. 16 depicts a perspective view of an illustrative embodiment of a carrier chamber brush attachment.
Figure 17:
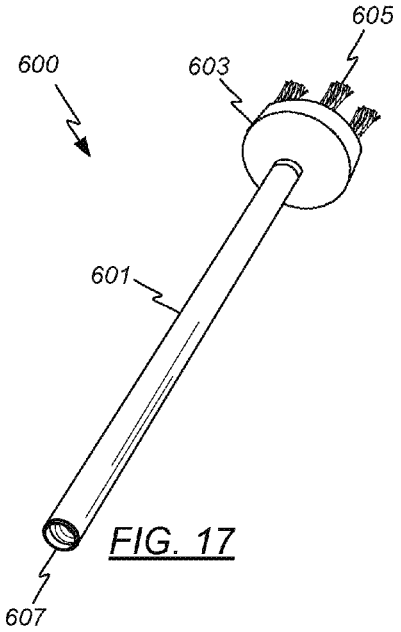
FIG. 17 depicts another perspective view of an illustrative embodiment of a carrier chamber brush attachment.

FIG. 16 depicts a perspective view of an illustrative embodiment of a carrier chamber brush 600, comprising a plurality of groups of axially extending bristles 605. Carrier chamber brush 600 has a body 601 with a brush base 603 attached thereto. Referring to the bolt carrier 700 depicted in FIG. 23, bolt carrier 700 includes an interior section 707 with a relatively flat interior back wall. Carrier chamber brush 600 may be ideally suited for extending into interior section 707 and cleaning the back wall thereof. The back side of the bolt carrier chamber tends to receive a great deal of carbon deposits which are difficult to remove without scraping. The geometry of this area typically differs from one manufacturer to another, so a rigid scraper, regardless of its geometry, can only be partially effective. The carrier chamber brush 600 may be sized properly so that the bristles flex into the open area which is back-bored and otherwise very difficult to reach with a fixed scraper geometry. FIG. 17 depicts another perspective view of carrier chamber brush 600, with body 601, brush base 603, and axially extending bristles 605. FIG. 17 also shows that body 601 may include a female threading portion 607 at the far end thereof from brush base 603 and axially extending bristles 605, so that carrier chamber brush 600 may be threaded onto and attached to other handles or other implements in the tool kit of this disclosure.

Carrier chamber brush 600 has five evenly spaced groups of axially extending bristles 605 in this illustrative embodiment, and in other embodiments may have three or seven evenly spaced groups of bristles, or may have an even number of groups of bristles in an uneven arrangement, for example. For example, referring briefly to FIG. 21, the carrier chamber brush 664 includes six groups of bristles in an uneven arrangement, but two or four groups is also contemplated. Each of these arrangements provides a particular advantage in light of a gas port on the side of the bolt carrier, so that when the carrier chamber brush 600 is used to scrape the interior of a bolt carrier, when one of the groups of bristles crosses the position of the gas port, there is not a diametrically opposite group of bristles pushing directly toward the gas port and providing a net off-axis force.

Figure 18:
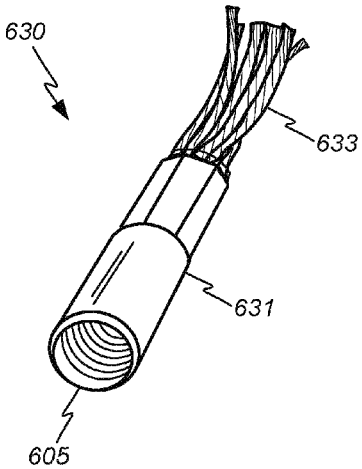
FIG. 18 depicts a perspective view of an illustrative embodiment of a carrier chamber brush attachment.
Figure 19:
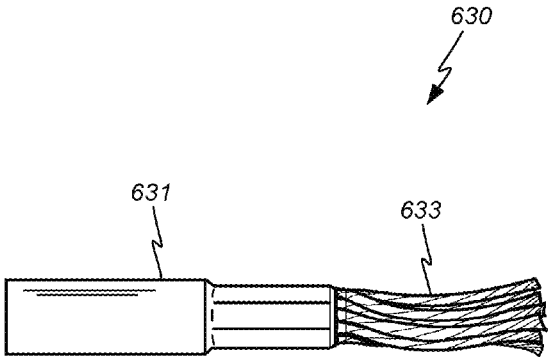
FIG. 19 depicts another perspective view of an illustrative embodiment of a carrier chamber brush attachment.
Figure 23:
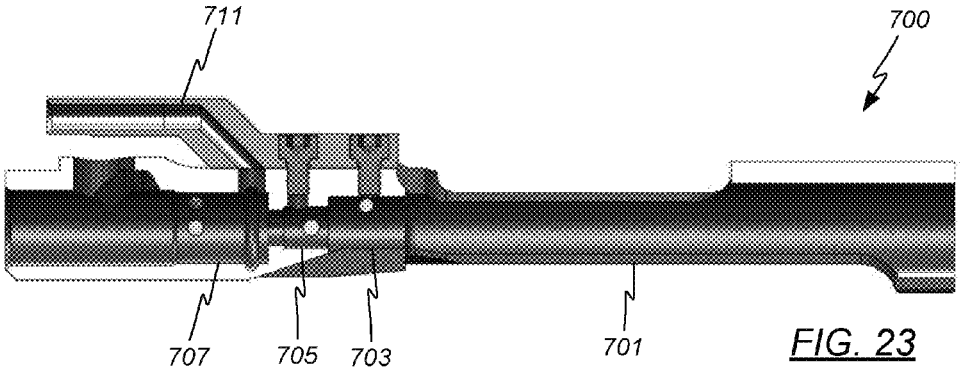
FIG. 23 depicts a side plan view of a bolt carrier, for reference.

FIG. 18 depicts a perspective view of an illustrative embodiment of a carrier chamber brush 630. FIG. 19 depicts another perspective view of carrier chamber brush 630. Carrier chamber brush 630 includes body 631 and brush bristles 633. Carrier chamber brush 630 may be well-suited for cleaning the interior of a carrier chamber 711 of a bolt carrier 700 as shown in FIG. 23. In particular, carrier chamber brush 630 may be created using the stiff segments typically used in a wire rope cable, in lieu of typical bristle material. Carrier chamber brush 630 may be particularly well-suited to scrape the back side of the carrier gas chamber using the stiff wire rope cable segment bristles, which may be cut to the proper length to be both stiff enough to scrape off carbon deposits, yet flexible enough to flex into areas that need to be scraped.

Figure 20:
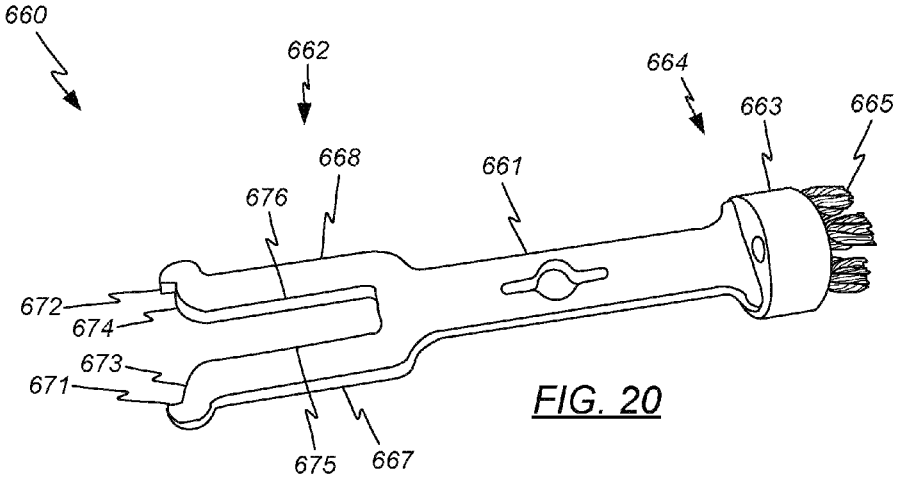
FIG. 20 depicts a perspective view of an illustrative embodiment of a cleaning tool with a bolt cleaning tool on one end and a carrier chamber brush on the other end.
Figure 21:
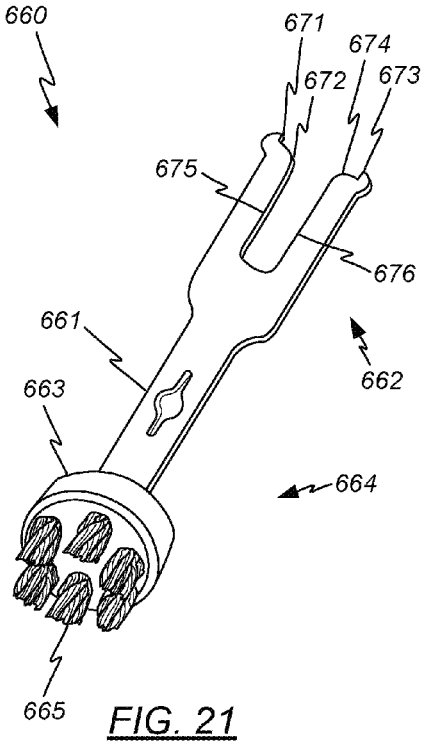
FIG. 21 depicts another perspective view of an illustrative embodiment of a cleaning tool with a bolt cleaning tool on one end and a carrier chamber brush on the other end.
Figure 24:
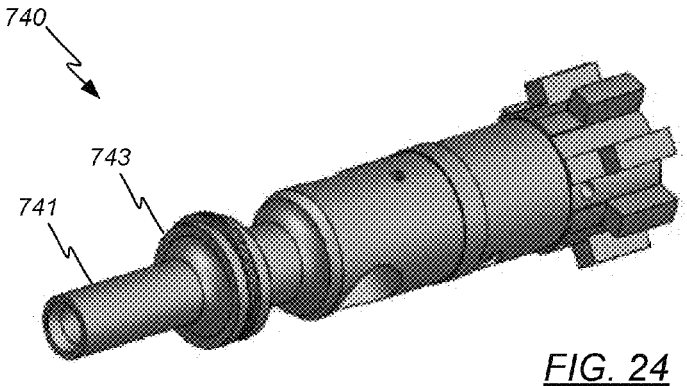
FIG. 24 depicts a side plan view of a bolt, for reference.
Figure 25:
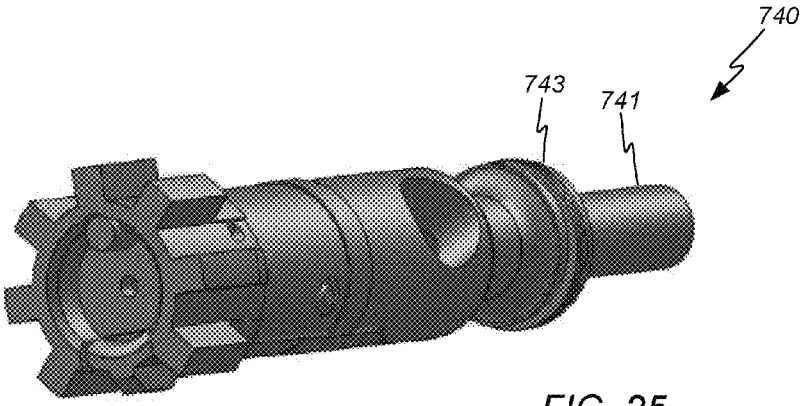
FIG. 25 depicts a side plan view of a bolt, for reference.

FIG. 20 depicts a perspective view of an illustrative embodiment of a cleaning tool 660 with a bolt cleaning tool 662 on one end of a tool core 661 and a carrier chamber brush 664 on the other end of the tool core. FIG. 21 depicts another perspective view of cleaning tool 660 with bolt cleaning tool 662 on one end and carrier chamber brush 664 on the other end. Carrier chamber brush 664 includes brush head 663 and axially extending bristles 665, similar in some ways to carrier chamber brush attachment 600 as shown in FIGS. 16 and 17. Various aspects of the geometry of bolt cleaning tool 662 are explained as follows, with reference also to bolt 740 depicted in FIGS. 24 and 25.

Bolt cleaning tool 662 includes a first arm 667 and an opposing second arm 668. Bolt cleaning tool 662 includes various inner surfaces that conform to the shape and size of the bolt face 743 and adjoining cylindrical section 741 of a bolt 740 in an off-center alignment, with first arm 667 and second arm 668 being placed in contact with bolt 740. These various inner surfaces include first gas ring scraper surface 671 and second gas ring scraper surface 672, first bolt face scraper surface 673, second bolt face scraper surface 674, first bolt cylinder scraper surface 675, and second bolt cylinder scraper surface 676. The second bolt face scraper surface 674 is positioned opposing the first bolt face scraper surface 673. The first gas ring scraper surface 671 extends from a first end of the first bolt face scraper surface 673, and the second gas ring scraper surface 672 extends from a first end of the second bolt face scraper surface 674, such that the second gas ring scraper surface 672 is positioned opposing the first gas ring scraper surface 671. The first bolt cylinder scraper surface 675 extends from a second end of the first bolt face scraper surface 673, and the second bolt cylinder scraper surface 676 extends from a second end of the second bolt face scraper surface 674, such that the second bolt cylinder scraper surface 676 is positioned opposing the first bolt cylinder scraper surface 675.

The second gas ring scraper surface 672 is positioned parallel to the first gas ring scraper surface 671, and the second bolt cylinder scraper surface 676 is positioned parallel to the first bolt cylinder scraper surface 675. The first bolt cylinder scraper surface 675 and the second bolt cylinder scraper surface 676 of the bolt cleaning tool 662 are sized to conformingly engage an off-center section of the cylindrical part of the bolt face 741 of the bolt 740, and are significantly longer than the first gas ring scraper surface 671 and the second gas ring scraper surface 672 of the bolt cleaning tool 662, which are sized to conformingly engage an off-center section of the shorter and wider cylindrical section 743 of the bolt 740. The first bolt cylinder scraper surface 675 and the second bolt cylinder scraper surface 676 are spaced apart from each other at a distance that is less than the diameter of the cylindrical bolt face 741 of the bolt 740, which configures these surfaces of bolt cleaning tool 662 for their off-center conforming contact with bolt face 741, in this illustrative example.

The first and second bolt face scraper surfaces 673, 674, the first and second gas ring scraper surfaces 671, 672, and the first and second bolt cylinder scraper surfaces 675, 676 are thereby shaped to conformingly engage a portion of bolt 740 in an off-center engagement with the portion of bolt 740. In particular, for example, the first gas ring scraper surface 671 and the second gas ring scraper surface 672 are spaced apart from each other at a distance that is less than the diameter of the cylindrical section 743 of bolt 740. Cylindrical section 743 serves as a gas sealing ring holding section of bolt 740; gas sealing rings (not depicted here) are typically disposed in an annular depression in cylindrical section 743, as is familiar to those skilled in this field of art.

Cleaning tool 660 may illustratively be composed of stainless steel, and may be formed using waterjet cutting, for example. In other embodiments, cleaning tool 660 may be composed of any of a variety of other materials, such as aluminum, titanium, various alloys, for example, and may be formed using any of a number of techniques such as laser cutting, computer numerical control (CNC) machining, or other methods, for example. Cleaning tool 660 features mostly rectangular edges, or right-angle edges with curved convex or concave surfaces, which facilitates fabrication relative to more complicated forms.

Cleaning tool 660 provides a number of additional advantages. Bolt cleaning tool 662 is thin enough to allow a degree of flexibility to aid in truly conforming to the surfaces of the cylindrical section 741 and bolt face 743 of bolt 740, instead of being thick enough to be completely rigid and unable to flex to conform to the complex surfaces of bolt 740. This flexible conformity facilitates the edges of the forward section of bolt cleaning tool 662 forming a true scraping edge against the surfaces of bolt 740. The sizing and shaping of bolt cleaning tool 662 that result in the off-center engagement with bolt 740 also ensure that it is the edges of the surfaces of the bolt cleaning tool 662, not the full-on surfaces, that engage the surfaces of bolt 740, which also facilitates a true scraping engagement. The off-center conforming shape also means bolt cleaning tool 662 has a smaller size than if it were sized to conform over the center of the bolt face 743 of the bolt 740. This smaller size, along with the thinness of bolt cleaning tool 662, also makes for a lighter weight, which in turn makes bolt cleaning tool 662 more suitable for field use. This smaller size may also enable bolt cleaning tool 662 to fit inside the stock of a rifle to which bolt 740 belongs, such as an M4 or an M16, while larger bolt scraper tools would not be able to.

Figure 22:
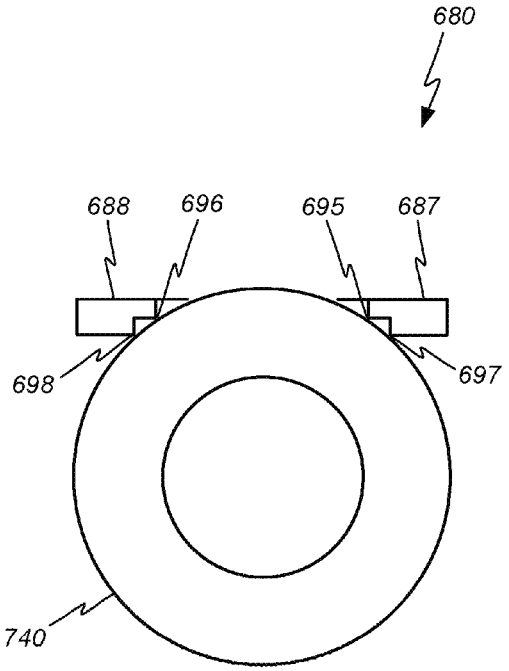
FIG. 22 depicts a cross-sectional top plan view of an illustrative embodiment of a double-edged bolt cleaning tool engaged with a bolt.

FIG. 22 depicts a cross-sectional top plan view of an illustrative embodiment of a double-edged bolt cleaning tool 680 engaged with a bolt 740. Double-edged bolt cleaning tool 680 is similar to bolt cleaning tool 662 except that it has effectively two bolt cleaning tools of different dimensions stacked on top of each other, to provide two sets of scraping edges on each side. First arm 687 of double-edged bolt cleaning tool 680 includes first scraping edge 695 and second scraping edge 697, each analogous to first bolt cylinder scraper surface 675 of bolt cleaning tool 662 in FIGS. 20 and 21, while second arm 688 of double-edged bolt cleaning tool 680 includes first scraping edge 696 and second scraping edge 698, each analogous to second bolt cylinder scraper surface 676 of bolt cleaning tool 662 in FIGS. 20 and 21. These scraping edges may be similarly extended along curving and then additional straight sections analogously to two sets of surfaces 671, 673, 672, and 674 of bolt cleaning tool 662 in FIGS. 20 and 21. First scraping edge 695 and second scraping edge 697 of first arm 687 and first scraping edge 696 and second scraping edge 698 of second arm 688 may all contact cylindrical section 741 of bolt 740 at the same time, with a user pressing double-edged bolt cleaning tool 680 against bolt 740 and rotating them around against each other, to effectively scrape carbon scoring and other residue clean from bolt 740.

Any combination of the various tools described above, potentially along with still other tools and components, may be included together in an integral tool kit, in different embodiments. For example, different embodiments may have an integral casing, such as in the form of an integral combination handle and kit case such as handle 103 of FIGS. 1 and 2, where the casing has means to securely hold different tools and/or conforming compartments into which different tools may fit, such as any or all of bolt tool 200, an individual scraper wall 201, carrier interior scraper 300, long brush 400, long brush 450, chamber brush 500, carrier chamber brush 600, cleaning tool 660, potentially in combination with any or all of the various tools depicted in FIG. 1 and described in reference thereto. The casing may includes elements for securely holding each of the tools in it, either by a secure fastening connection or a conformingly fitting compartment.

This may provide for additional advantages such as enabling a user to screw carrier interior scraper 300 or chamber brush 500 into female rod 117 to allow these tools to be inserted into hard-to-reach internal areas of components. Providing a combination of these tools in a single integral tool kit that securely fastens them or provides securely fitting compartments for them may advantageously enable a user to transport all the necessary tools in a field setting, and to clean components such as a bolt and a bolt carrier quickly and effectively in a field setting.

While various embodiments have been particularly shown and described, it will be understood by those skilled in the art that various combinations of the disclosed elements or changes in detail may be made without departing from the scope of the claims. For example, other embodiments may illustratively include a single conforming set of scraping edges rather than two opposing sets of scraping edges, and may be housed with or without an aperture or other form of guide defined by a tool handle. Other variations may also be made within the realm of different embodiments, limited only by the scope of the claims as recited below.

What is claimed is:

1. A cleaning tool for a firearm bolt, the firearm bolt including a gas ring portion and a bolt face having a cylindrical portion with a cylindrical portion diameter and a concave surface extending radially outward from a terminus of the cylindrical portion, the cleaning tool comprising:

a tool core defining a plurality of scraper surfaces, including:

a convex bolt face scraper surface extending from a forward section of the tool core, the bolt face scraper surface conforming in an off-center alignment to the concave surface of the bolt face; and a bolt cylinder scraper surface of a rectangular slot comprising two opposing substantially flat inner walls which define a slot width less than the cylindrical portion diameter of the cylindrical portion of the bolt extending from a terminus of the convex bolt face scraper surface, the bolt cylinder scraper surface conforming in an off-center alignment to the cylindrical portion of the firearm bolt.

2. The cleaning tool according to claim 1, further comprising a plurality of convex bolt face scraper surfaces and a plurality of bolt cylinder scraper surfaces.

3. The cleaning tool according to claim 2, wherein the plurality of bolt cylinder scraper surfaces are opposed from each other at a distance that is less than the cylindrical portion of the firearm bolt.

4. The cleaning tool according to claim 1, further comprising a gas ring scraper surface extending from the first end of the tool core, the convex bolt face scraper surface extending from the gas ring scraper surface.

5. The cleaning tool according to claim 4, further comprising a plurality of gas ring scraper surfaces.

6. The cleaning tool according to claim 5, wherein the plurality of gas ring scraper surfaces are opposed from each other at a distance that is less than the gas ring portion of the firearm bolt.

7. The cleaning tool according to claim 1, wherein the bolt cleaning tool is sized to conformingly engage a bolt face of an M16 rifle bolt in an off-center engagement with the bolt face of the M16 rifle bolt.

8. The cleaning tool according to claim 1, wherein the convex bolt face scraper surface and the bolt cylinder scraper surface include a scraping edge.

9. The cleaning tool according to claim 8, wherein the scraping edge of the convex bolt face scraper surface is adjoined to the scraping edge of the bolt cylinder scraper surface.

10. The cleaning tool according to claim 8, further comprising a gas ring scraper surface having a scraping edge.

11. The cleaning tool according to claim 10, wherein the scraping edge of the gas ring scraper is adjoined to scraping edge of the convex bolt face scraper surface.

12. The cleaning tool for a firearm bolt of claim 1, wherein said tool core flexes to conform to the bolt face.

* * * * *